United States Patent [19]

Brown

[11] 4,232,648

[45] Nov. 11, 1980

[54] THROWING SLING

[76] Inventor: Douglas P. Brown, 18 Loba Dr. Groom Creek Rt., Prescott, Ariz. 86301

[21] Appl. No.: 970,290

[22] Filed: Dec. 18, 1978

[51] Int. Cl.[3] ..... F41B 3/04

[52] U.S. Cl. ..... 124/5; 124/41 R

[58] Field of Search ..... 124/1, 5, 41 R; 24/49 S, 115 K, 205 R, 116 A, 136 R, 115 H

[56] References Cited

U.S. PATENT DOCUMENTS

| | | | |
|---|---|---|---|
| 1,401,340 | 12/1921 | Lindsay | 24/115 H |
| 1,419,682 | 6/1922 | Miles | 124/5 |
| 1,776,435 | 9/1930 | Isbell | 124/5 |
| 2,644,441 | 7/1953 | Simko | 124/5 |
| 4,131,102 | 12/1978 | Polly | 124/5 |

FOREIGN PATENT DOCUMENTS

| | | | |
|---|---|---|---|
| 907605 | 10/1962 | United Kingdom | 24/49 S |

*Primary Examiner*—Richard C. Pinkham
*Assistant Examiner*—William R. Browne
*Attorney, Agent, or Firm*—Charles E. Cates

[57] ABSTRACT

The disclosure teaches an improved projectile throwing sling of the type having a pocket and two thongs wherein a supple pocket is provided to provide gripping power pending the throw and wherein at least one weight is carried by the sling at the release end of the pocket. A weight which simultaneously fastens the release thong to the release end of the pocket is taught and matched weight disposed at each end of the pocket and adapted to simultaneously fasten the release and tether thongs to the two ends of the pocket are also taught.

5 Claims, 3 Drawing Figures

THROWING SLING

BACKGROUND OF THE INVENTION

The invention relates to improvements in projectile throwing slings and particularly to improvements in the performance capabilities of such devices.

Slings for use in throwing projectiles have been known since antiquity, an early recorded use having been the use of a sling by David against Goliath. Slings are used for amateur pursuits, such as hunting and target shooting in modern times, and the popularity of a sling as an instrument of amusement and recreation persists.

One of the enduring problems with the sling is that if the pocket of the sling is satisfactorily supple and therefore adapted to enfold and retain the projectile, especially round projectiles such as marbles and the like, the release of the projectile is not crisp and definite, possibly due to an uncertain and lazy movement of the end of the pocket attached to the release string.

This makes the aiming and release of the projectile uncertain and produces unwanted errors in the throw. For the amateur sling sportsman this is a serious handicap to overcome.

Consequently, there has been a long standing need and desire for a sling that has a pocket for holding the projectile that is supple enough to provide some gripping function, but that nevertheless releases the projectile crisply and cleanly from the pouch or pocket on the throw.

An object of this invention is to solve this long standing problem of the prior art and satisfy the need for an improvement addressed to it.

BRIEF SUMMARY OF THE INVENTION

Accordingly, I provide an improved sling which has a supple pocket, thongs engaging opposite ends of the pocket and weight means conveniently weighted perforated beads through which the ends and the shank of the thongs that engage the pocket pass through and are secured, disposed at the end of the pocket attached to the release thong, whereby the end of the pocket attached to the release thong snaps open crisply upon the throw and the projectile is cleanly released.

DETAILED DESCRIPTION OF THE PREFERRED EMBODIMENT

A more complete understanding of the invention may be obtained with reference to the drawing in which a presently preferred embodiment of the invention is depicted:

Figure 1:
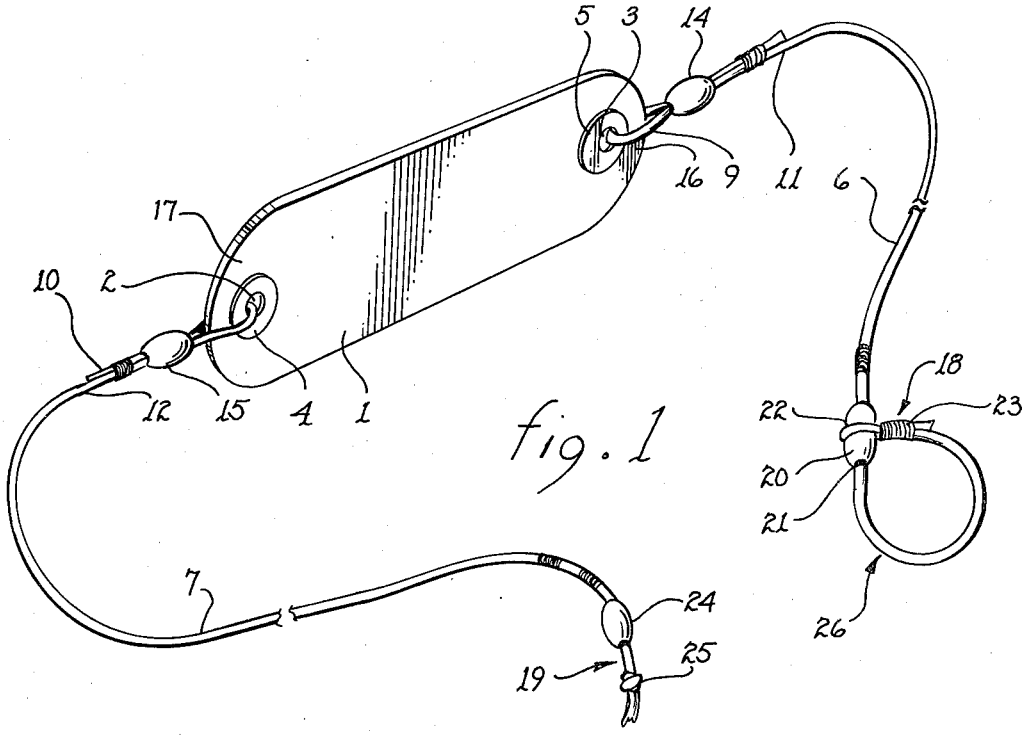
FIG. 1 is a perspective view of a presently preferred embodiment of the invention.
Figure 2:
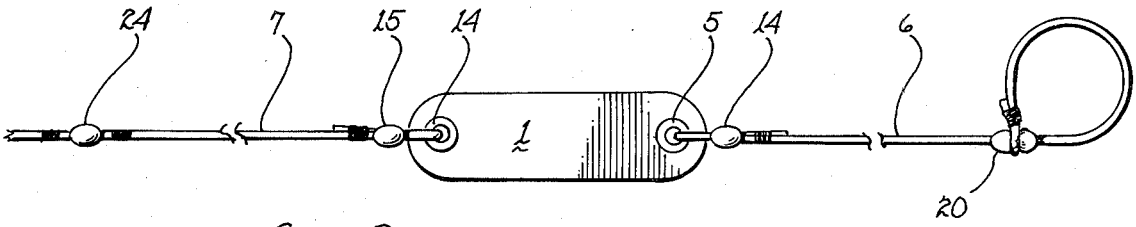
FIG. 2 is a plan view of the invention relative the pocket.
Figure 3:
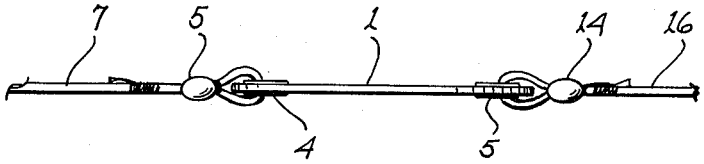
FIG. 3 is an elevation view of the pocket of the invention.

In the preferred embodiment of the invention a pocket 1 made of a supple leather whose measurements are approximately 4½ inches by 2 inches is provided with apertures 2, 3 protected by metal eyelets 4,5; two thongs designated as tether thong 6 and release thong 7 have first ends 9, 10 which are passed through eyelet 4 and doubled back upon the shanks 11, 12 and secured by one ounce steel beads 14, 15 which are snugged up close to the ends 16, 17 of the pocket 1. The loose ends are conventionally bound by threads.

The second ends 18, 19 are treated as follows: The second end 18 of tether thong 6 is provided with a wooden bead 20 through whose aperture 21 the shank of the tether thong is passed and whose second end 18 is looped over the bead in a groove 22 provided for that purpose and bound to the shank by cords 23. The second end 19 of release thong 7 carries a wooden bead 24 whose aperture receives the shank of the thong 7 and which is retained by means of knot 25 tied in the thong.

In operation a projectile such as a marble or other suitable object is placed in the supple pouch which provides enough of a gripping action on the projectile to retain it pending the throw. The finger loop 26 is placed around the right index finger and the thong 7 is gripped between thumb and first finger by the adjustable bead 24. The object is sighted and the pocket and enclosed projectile, which are held with the left hand at this point, are released permitting a backward motion of the pocket which is in one continuous motion whipped behind the head and brought to the side and thrown forward by releasing thong 7 at the proper time.

In actual tests the inventor has demonstrated to his satisfaction that the release of the projectile from the pocket is crisper and cleaner than the prior art devices not having the disadvantages of a weighted bead disposed at the release end of the pocket to snap open the pocket.

Persons ordinarily skilled in the art will appreciate from a study of the foregoing disclosure that various equivalent alternatives can be employed, all of which are contemplated to the extent they are fairly embraced in the appended claims.

What is claimed is:

1. A projectile throwing sling comprising a supple pocket, thongs engaging opposite ends of said pocket, and weight means comprising a perforated bead that also serves to tie the release thong to the release end of the pocket, said weight means being carried at the release end of said pocket whereby the release of a projectile is aided by the weight means causing said release end of the pocket to snap open crisply upon the throw of a projectile.

2. The sling of claim 1 with the addition of a second bead on the opposite end from said release end of said pocket to provide a balanced sling.

3. The sling of claim 1 wherein the bead weighs about one ounce.

4. The sling of claim 2 wherein the bead that ties said release thong to said pocket weighs about one ounce.

5. A projectile throwing sling comprising a supple pocket, thongs engaging opposite ends of said pocket, and weight means comprising about one ounce carried at the release end of said pocket whereby the release of a projectile thrown by said sling is aided by said weight means causing the end of the pocket attached to the release thong to snap open crisply upon the throw of the projectile.

* * * * *